US007041923B2

(12) United States Patent
Lin et al.

(10) Patent No.: US 7,041,923 B2
(45) Date of Patent: May 9, 2006

(54) KEYSWITCH STRUCTURE

(75) Inventors: Hsien-Ming Lin, Panchiao (TW); Hai-Nan Shen, Guangdong (CN); Ke-Cheng Wang, Xi'an Shanxi (CN)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 11/230,459

(22) Filed: Sep. 21, 2005

(65) Prior Publication Data

US 2006/0076222 A1 Apr. 13, 2006

(30) Foreign Application Priority Data

Oct. 8, 2004 (TW) ..... 93216053 U

(51) Int. Cl.
*H01H 13/50* (2006.01)

(52) U.S. Cl. ..... 200/296; 200/341; 200/343

(58) Field of Classification Search ..... 200/5 A, 200/296, 341–345; 341/22; 345/168, 169; 400/490–496

See application file for complete search history.

(56) References Cited

U.S. PATENT DOCUMENTS

| | | | | |
|---|---|---|---|---|
| 3,941,953 | A * | 3/1976 | Misson et al. | 200/5 R |
| 4,430,531 | A * | 2/1984 | Wright | 200/5 A |
| 5,739,486 | A * | 4/1998 | Buckingham | 200/5 A |
| 5,749,457 | A * | 5/1998 | Castaneda et al. | 200/343 |
| 5,813,520 | A * | 9/1998 | Reier et al. | 200/343 |
| 6,054,662 | A * | 4/2000 | Hrehor et al. | 200/343 |
| 6,504,119 | B1 * | 1/2003 | Ribeiro | 200/341 |
| 6,726,093 | B1 | 4/2004 | Hsu et al. | |
| 6,867,384 | B1 * | 3/2005 | Ichihara et al. | 200/343 |
| 6,933,454 | B1 * | 8/2005 | Ishibashi et al. | 200/341 |

* cited by examiner

*Primary Examiner*—Michael A. Friedhofer
(74) *Attorney, Agent, or Firm*—Birch, Stewart, Kolasch & Birch, LLP

(57) ABSTRACT

A keyswitch structure has a slender key cap and an integral balance structure for a key with a short press stroke. The keyswitch structure has a casing and at least one key. The casing has at least one pair of hooks arranged on a bottom face thereof, and at least one receiving groove. The key has a key cap, a connection portion parallel extended from a bottom portion of the key cap, and a balance rod integrally arranged on an end side of the connection portion. The balance rod has two sides arranged in the two hooks, respectively. The present invention can simplify the assembly steps, and efficiently prevent the key from swinging and being wedged.

20 Claims, 6 Drawing Sheets

KEYSWITCH STRUCTURE

BACKGROUND OF THE INVENTION

1. Field of the Invention

The present invention relates to a keyswitch structure, and particularly relates to a keyswitch structure including a slender key cap and an integral balance structure for a key with a short press stroke.

2. Description of Related Art

Keyswitch structures are widely utilized in many devices, such as computers, telephones, cell phones or operational panels of machines, for inputting data or actuating such devices. Efforts have been made to improve the keyswitch structure so as to have a more reliable operation.

In order to distribute the force of the keyswitch, the keyswitch usually has a scissors structure arranged under a key cap of the keyswitch. No matter how the force is acted on a lateral edge or a lateral side of the keyswitch, the force can be averagely distributed over the whole keyswitch for user to press the keyswitch easily. A portable keyswitch has a strict space limitation in a notebook or a foldable keyswitch, and usually has a scissors structure for convenient operation.

Moreover, with regard to a wider keyswitch such as space key, in order to distribute the force on the lateral side, the key cap usually has a metal balance rod arranged under the key cap. The balance rod is used to balance the two lateral forces for preventing the key from swinging and being wedged.

U.S. Pat. No. 6,726,093 B2 is published on Apr. 27, 2004, and discloses a key structure having a scissors frame and a balance rod. FIG. 1 shows a perspective, exploded view of the key structure of the related art. The key structure includes a bottom seat 4*a*, a key cap 1*a* arranged on the bottom seat 4*a*, a balance rod 3*a* arranged between the key cap 1*a* and the bottom seat 4*a*, and a scissors structure 2*a* arranged between the bottom seat 4*a* and the key cap 1*a*. The balance rod 3*a* has a first side 31*a* connected to a sliding groove 11*a* that is formed on a bottom portion of the key cap 1*a*, and a second side 32*a* connected to a guiding groove 43*a* of the bottom seat 4*a*. The key cap 1*a* can be upwardly and downwardly moved relative to the bottom seat 4*a* by the scissors structure 2*a* and the balance rod 3*a*.

However, the key structure is difficult to adapt to a key under strict space limitations. First, the keyswitch structure cannot adapt to a slender key cap, because the key cap needs a larger area for the scissors structure 2*a* and the balance rod 3*a* to be arranged on the bottom portion thereof. The key structure is difficult to adapt to a slender key for assembly. Besides, the key structure is difficult to adapt to a key with a short press stroke like 0.5 mm to 2 mm for assembly, because the key structure has a longer press stroke. The whole height of the key is increased by the scissors structure 2*a* and the balance rod 3*a*. Moreover, the key structure has too many components and a complex assembly.

SUMMARY OF THE INVENTION

The present invention provides a keyswitch structure. The keyswitch structure is easy to operate for user, and is adaptable to a key under strict space limitations, such as a key with a short press stroke and a slender shape. Furthermore, the present invention simplifies the number of components and the installation steps.

The first aspect of the invention is a keyswitch structure. The keyswitch structure includes a casing and a key. The casing has a pair of hooks arranged on a bottom face thereof, and a receiving groove. The key has a slender key cap, a connection portion and a balance rod. The slender key cap is arranged inside the receiving groove, wherein a top of the slender key cap is exposed outside the receiving groove. The connection portion is parallel extended from a bottom portion of the slender key cap. The balance rod is integrally arranged on an end side of the connection portion, and having two sides rotatably arranged inside the corresponding hooks.

The second aspect of the invention is a keyswitch structure. The keyswitch structure includes a casing and at least one key. The casing has at least one pair of hooks arranged on a bottom face thereof, and at least one receiving groove. The key has a key cap, a connection portion parallel extended from a bottom portion of the key cap, and a balance rod integrally arranged on an end side of the connection portion. The balance rod has two sides arranged in the hooks, respectively.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawing, in which.

DETAILED DESCRIPTION OF PREFERRED EMBODIMENTS

Figure 1:
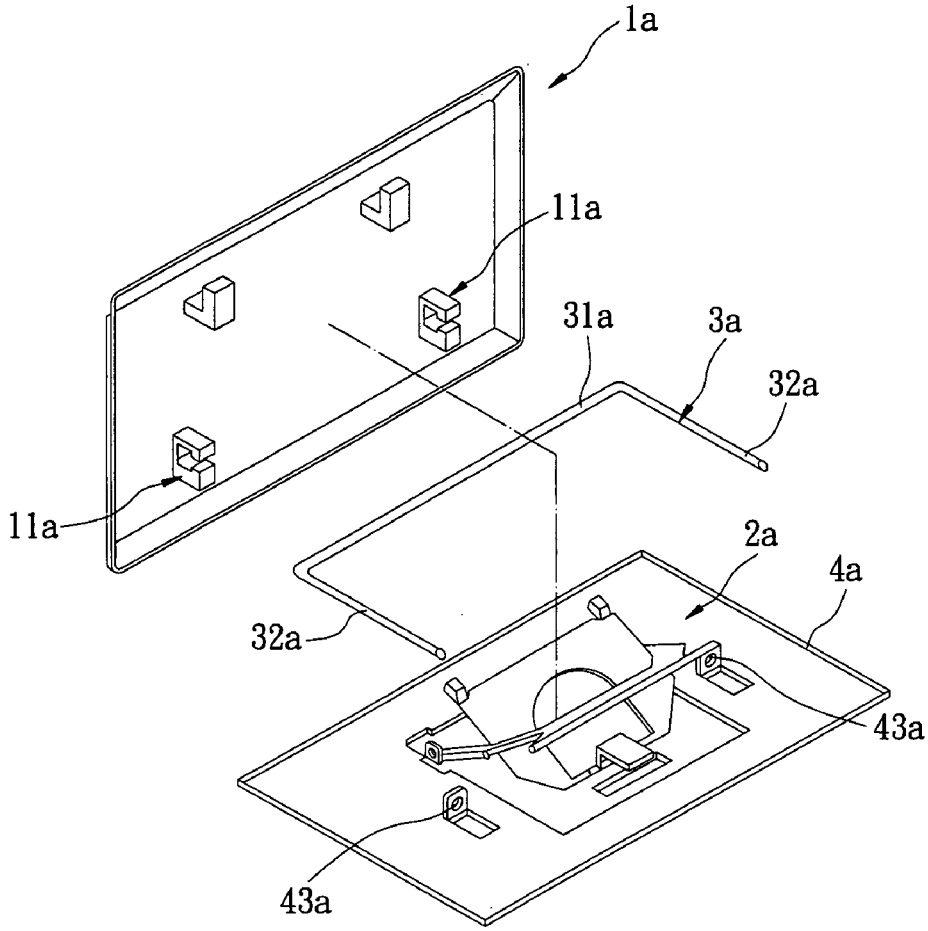
FIG. 1 PRIOR ART
FIG. 1 is a perspective, exploded view of the key structure of the prior art.
Figure 2:
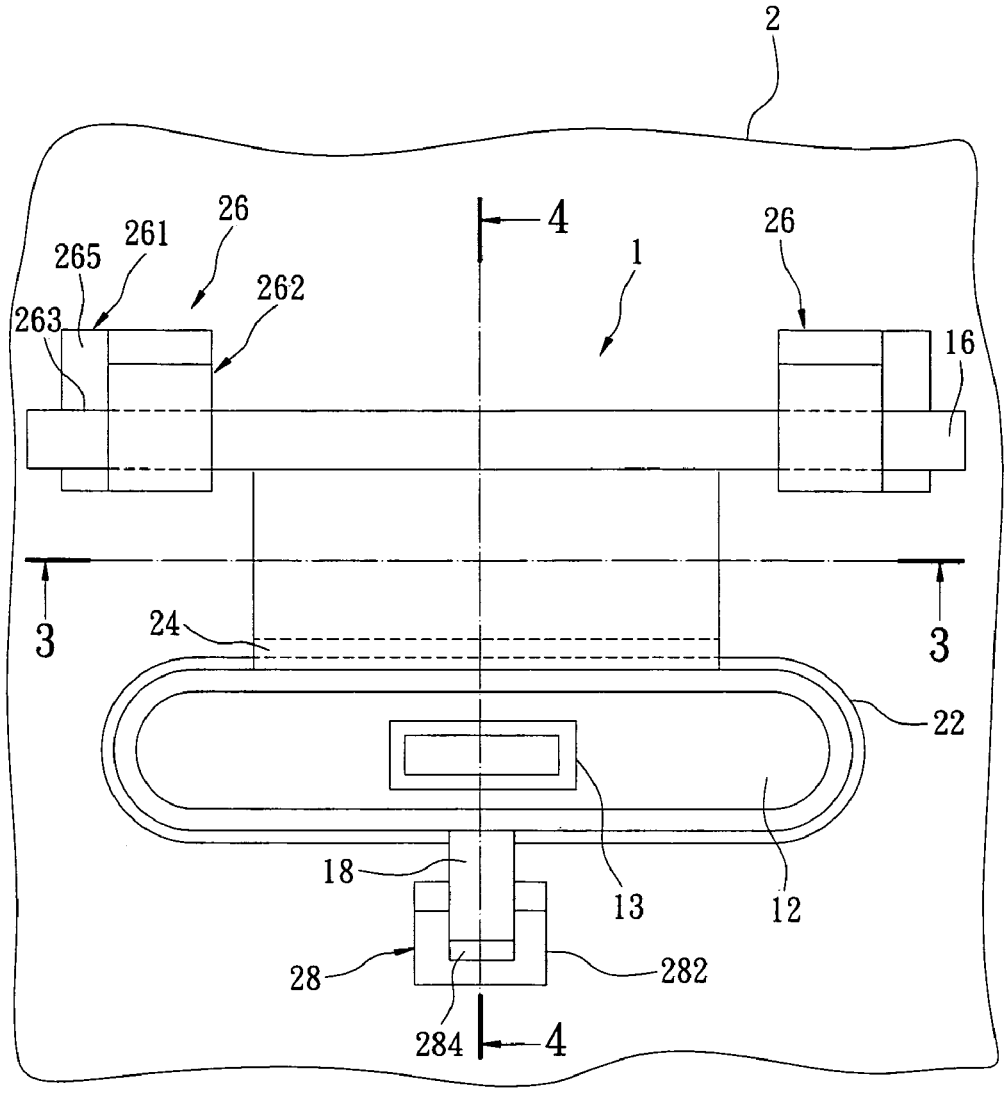
FIG. 2 is a bottom view of the keyswitch structure of the present invention.
Figure 3:
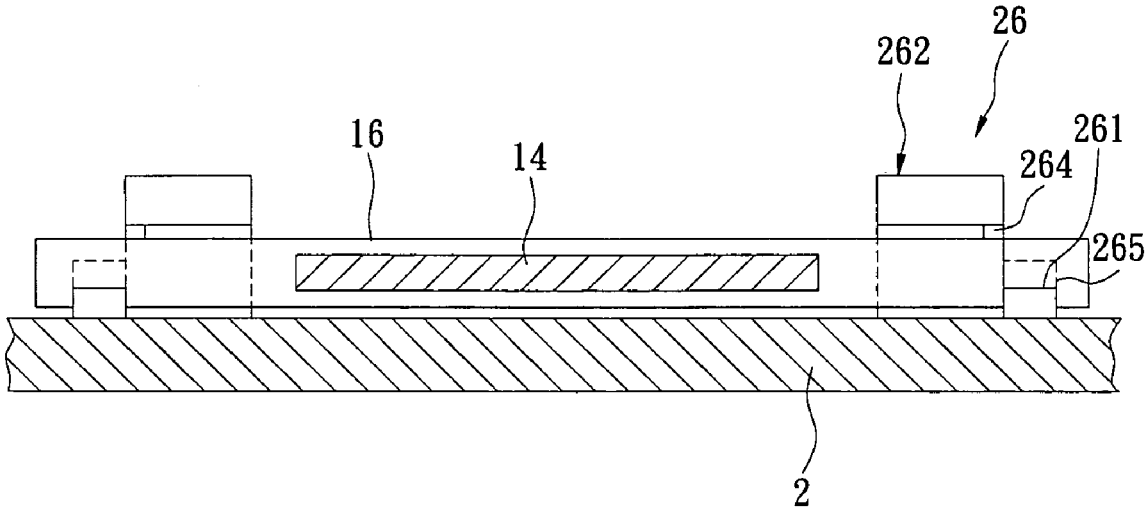
FIG. 3 is a cross-sectional view along line 3—3 shown in FIG. 2 according to the keyswitch structure of the present invention.

FIGS. 2 and 3 show a bottom view of the keyswitch structure, and a cross-sectional view along line 3—3 shown in FIG. 2 according to the keyswitch structure of the present invention, respectively. The present invention provides a keyswitch including a key 1 and a casing 2. The key 1 can be a switch for a PDA, or an access key arranged on a front side of a keyswitch.

The casing 2 has a receiving groove 22, and a pair of hooks 26 that can be arranged on a bottom face thereof. Preferably, the hooks 26 are integrally arranged on the bottom face of the casing 2.

The key 1 includes a key cap 12, a connection portion 14 and a balance rod 16, which are preferably integrally assembled as a single piece. In one preferred embodiment, the key cap 12 has a slender shape. The connection portion 14 is panel-shaped, and is extended from a bottom portion of the key cap 12 horizontally. The balance rod 16 is column-shaped, and is integrally arranged on an end side of the connection portion 14. The key cap 12 protrudes out of the receiving groove 22 of the casing 2, allowing the user to press the same. The balance rod 16 has two sides rotatably arranged in the hooks 26, respectively. The balance rod 16 is not limited to a column and can be, for example, polygon column-shaped. The connection portion 14 is not limited to a being board-shaped and can be, for example, two connection rods.

Figure 4:
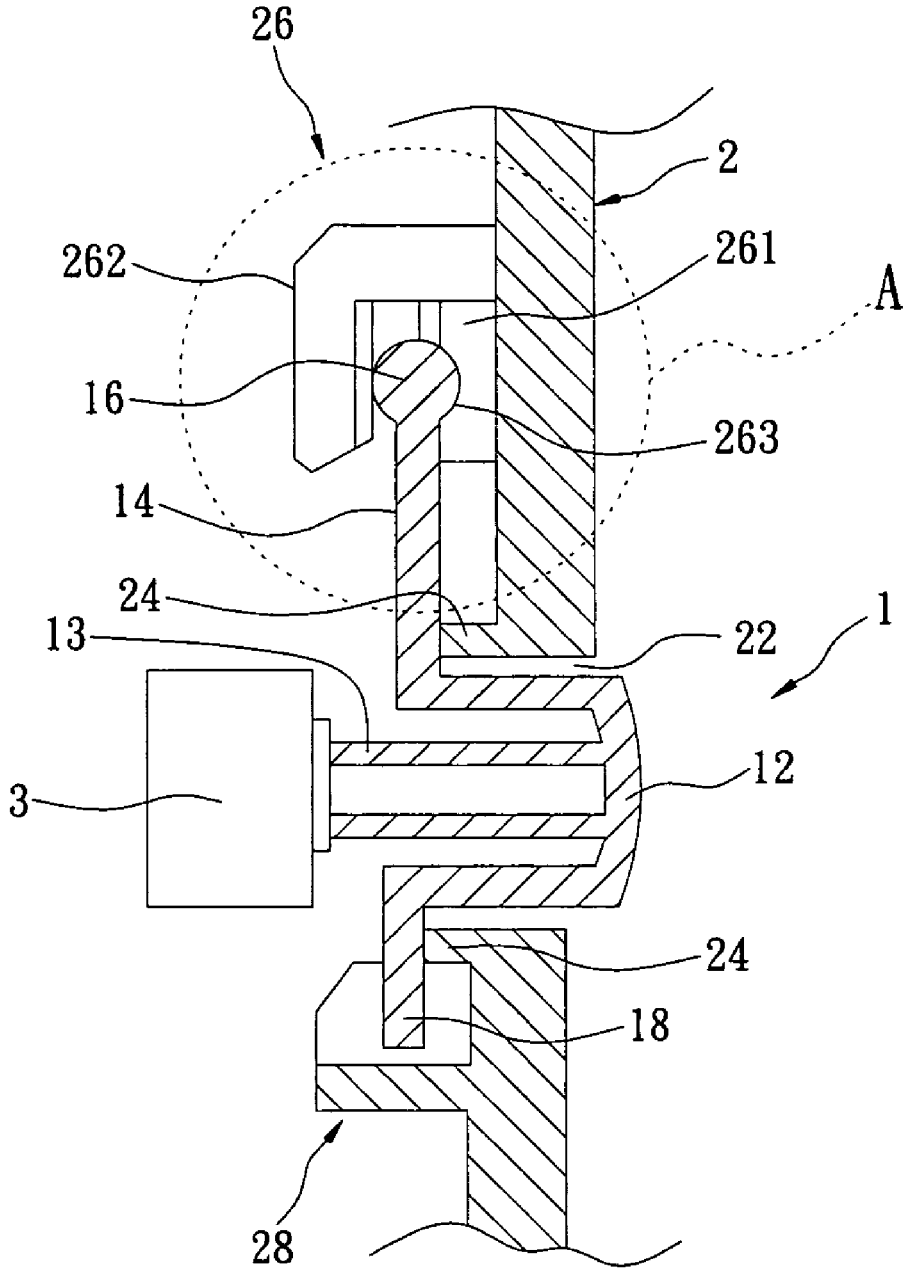
FIG. 4 is a cross-sectional view along line 4—4 shown in FIG. 2 according to the keyswitch structure (not yet pressed) of the present invention.
Figure 4A:
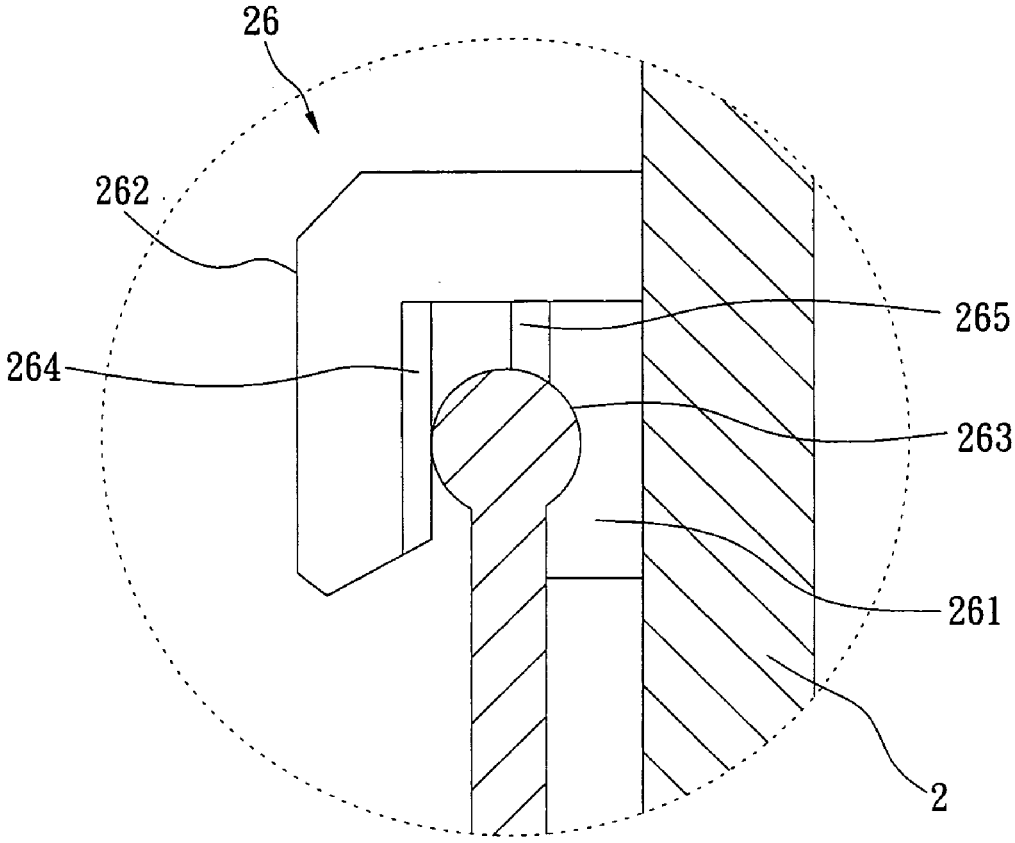
FIG. 4A is a magnifying view of area A of FIG. 4 according to the present invention.

FIGS. 4 and 4A show a cross-sectional view along line 4—4 shown in FIG. 2 according to the keyswitch structure (not yet pressed), and a magnifying view of area A of FIG. 4 according to the present invention, respectively. According to the best mode, each of the hooks 26 has a base portion 261 projected from the bottom face of the casing 2, and a bracket 262 with a L-shaped arranged on one side of the base portion 261. The base portion 261 and the bracket 262 are mated to from an assembled opening (not shown), parallel to the casing 2. The bracket 262 supports a downward pressure force to hold steady the balance rod 16 and prevent the balance rod 16 from falling.

In order to install the balance rod 16 steadily in the hooks 26, the base portion 261 has an arc concave groove 263 mating with the balance rod 16 for limiting the key 1 to movement along a Y-direction. The base portion 261 further includes a stop portion 265 arranged inside the hook 26 for preventing the balance rod 16 from over-retention during assembly. The bracket 262 has a rib 264 projecting from an inner side thereof for reducing a friction force between the balance rod 16 and the hook 26.

The casing 2 has a flange 24 arranged on a bottom portion thereof and along the receiving groove 22 for holding the connection portion 14 of the key 1. The flange 24 can surround with the receiving groove 22, or partially project from the bottom portion of the casing 2.

The present invention can achieve a balance function by the above-mentioned structure. When pressing the key cap 12, the key 1 can upwardly and downwardly rotate in balance relative to the balance rod 16 for preventing the key 1 from lifting to face one side. The present invention can efficiently avoid swinging and retention to improve operation feel. The receiving groove 22 of the casing 2 has a positioning function for limiting the key cap 12 to movement in a vertical direction.

In order to operate the keyswitch structure more steadily, the key 1 further includes a positioning rib 18 arranged on one side of the key cap 12 and opposite to the connection portion 14. The casing 2 has a positioning seat 28 for the positioning rib 18 to be arranged vertically and movably inside the positioning seat 28. The positioning seat 28 is preferably integrally formed on the bottom face of the casing 2. The positioning seat 28 has a U-shaped wall 282. The U-shaped wall 282 has a positioning groove 284 for receiving the positioning rib 18. The key 1 is limited and cannot move left or right, resulting in a steady operation feel. The flange 24 of the casing 2 is used to correspondingly hold the positioning rib 18.

Figure 5:
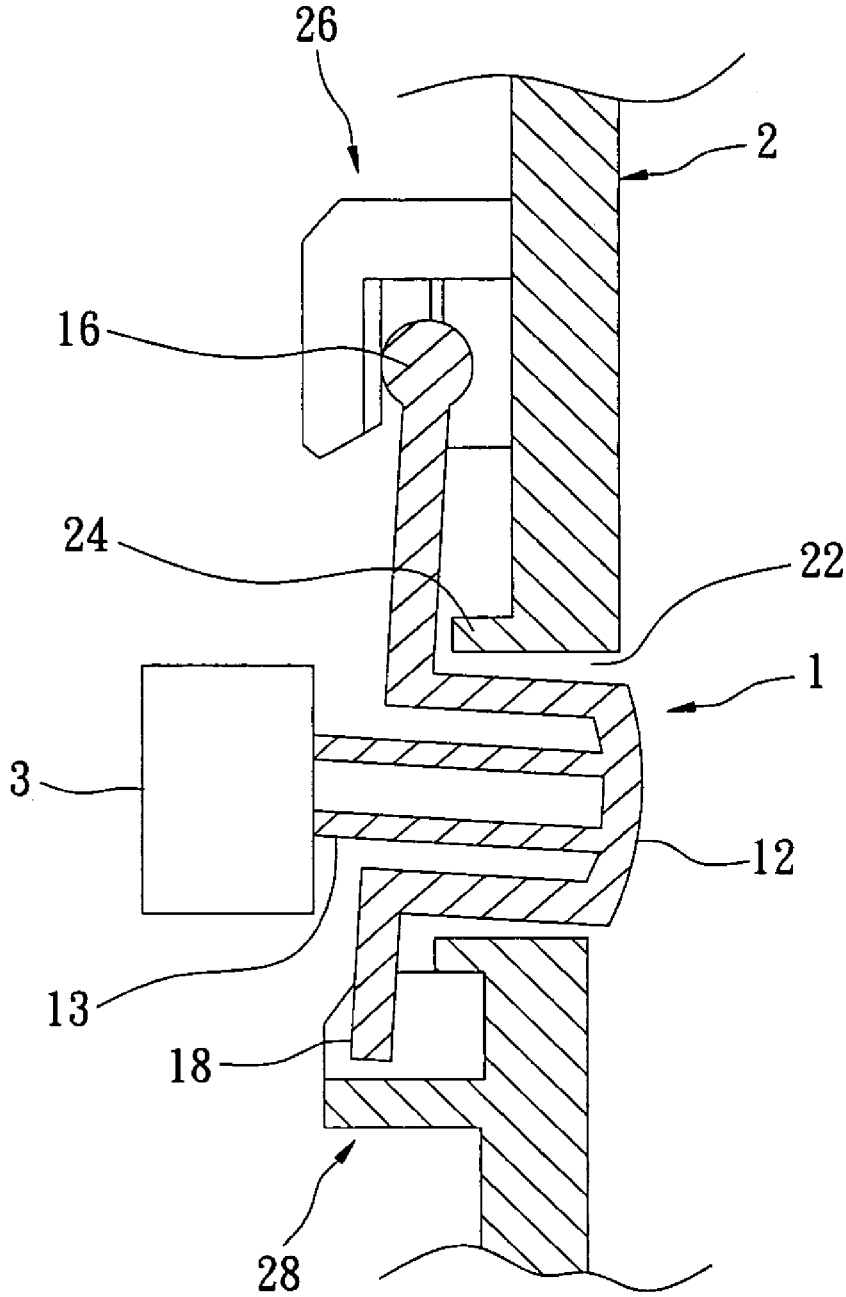
FIG. 5 is a cross-sectional view of when the keyswitch structure according to the present invention is pressed.

Referring to FIGS. 4 and 5, wherein FIG. 5 shows a cross-sectional view of when keyswitch structure according to the present invention is pressed. The keyswitch structure further includes a switch 3 arranged under the key cap 12. The key cap 12 has a moving portion 13 projected from a bottom portion thereof for retaining the switch 3. In the present embodiment, the switch 3 is a mechanical switch with a short press stroke. Of course, the switch 3 can be a keyswitch that has a dome and a printed circuit electrically connecting with the dome when pressing the dome to touch the printed circuit. Because the key cap 12 has a slender shape, the moving portion 13 is preferably a rectangular hollow pipe.

The keyswitch structure of the present invention can adapted to various devices, and in particular can be an access key arranged on a computer keyswitch. It is convenient for a user to open directly one device or function by the slender key cap. The key can be arranged front of the keyswitch and on the bottom face of the casing, and the hook and the positioning seat can be integrally formed on the bottom portion of the casing. Moreover, the balance rod of the key can be arranged inside a front side of the casing for increasing the available space.

The installation process of the present invention is very simple. First, the balance rod 16 of the key 1 is arranged inside the hooks 26, and then the positioning rib 18 is inserted inside the positioning groove 284 of the positioning seat 28 to finish the installation of the keyswitch structure.

To sum up, the present invention has some creative characteristics, including:

(1) The present invention can solve the questions of when the two sides of the slender key swing or are wedged for easily pressing the key. The concave groove and the balance rod are mated together to provide a limiting function, and the positioning rib and the positioning seat are mated together to provide a limiting function, too.

(2) The present invention does not use a metal balance rod and a scissors structure for reducing the cost.

(3) The arranged step of the present invention is very simple for reducing assembly time and manpower.

(4) The present invention can avoid erroneous assembly. The stop portion of the hook prevents the balance rod from over-retention.

Although the present invention has been described with reference to the preferred embodiment thereof, it will be understood that the invention is not limited to the details thereof. Various substitutions and modification have suggested in the foregoing description, and other will occur to those of ordinary skill in the art. Therefore, all such substitutions and modifications are intended to be embraced within the scope of the invention as defined in the appended claims.

What is claimed is:

1. A keyswitch structure comprising:

a casing comprising a pair of hooks arranged on a bottom face thereof, and a receiving groove; and a key comprising:

a slender key cap arranged inside the receiving groove, wherein a top of the slender key cap is exposed outside the receiving groove;

a connection portion parallel extended from a bottom portion of the slender key cap; and a balance rod integrally arranged on an end side of the connection portion, and having two sides rotatably arranged inside the corresponding hooks.

2. The keyswitch structure as claimed in claim 1, wherein the slender key cap has a moving portion projected from the bottom portion thereof for retaining a switch.

3. The keyswitch structure as claimed in claim 2, wherein the moving portion is a rectangular hollow pipe.

4. The keyswitch structure as claimed in claim 1, further comprising a positioning rib arranged on one side of the slender key cap, and the casing having a positioning seat for the positioning rib to be movably arranged inside the positioning seat.

5. The keyswitch structure as claimed in claim 4, wherein the positioning seat is integrally formed on the bottom face of the casing and has a U-shaped wall, wherein the U-shaped wall has a positioning groove for receiving the positioning rib.

6. The keyswitch structure as claimed in claim 1, wherein the connection portion has a board-shaped.

7. The keyswitch structure as claimed in claim 1, wherein the hook is integrally formed on the bottom face of the casing.

8. The keyswitch structure as claimed in claim 1, wherein each of the hooks has a base portion projected from the bottom face of the casing, and a bracket with a L-shaped arranged on one side of the base portion, wherein the base portion and the bracket are mated together to form an assembled opening.

9. The keyswitch structure as claimed in claim 8, wherein the base portion has an arc concave groove formed thereon, and the balance rod is column-shaped or polygon column-shaped.

10. The keyswitch structure as claimed in claim 8, wherein the base portion includes a stop portion arranged inside the hook.

11. The keyswitch structure as claimed in claim 8, wherein the bracket has a rib projected from an inner side thereof.

12. A keyswitch structure comprising:

a casing having at least one pair of hooks arranged on a bottom face thereof, and at least one receiving groove;

at least one key having a key cap, a connection portion parallel extended from a bottom portion of the key cap, and a balance rod integrally arranged on an end side of the connection portion, wherein the balance rod has two sides arranged in the hooks, respectively.

13. The keyswitch structure as claimed in claim 12, further comprising a switch arranged under the key cap, and the key cap having a moving portion projected from a bottom portion thereof for retaining the switch.

14. The keyswitch structure as claimed in claim 12, wherein the key comprises a positioning rib arranged on one side of the key cap, and the casing comprises a positioning seat for the positioning rib to be movably arranged inside the positioning seat.

15. The keyswitch structure as claimed in claim 14, wherein the positioning seat is integrally formed on the bottom face of the casing and has a U-shaped wall, wherein the U-shaped wall has a positioning groove for receiving the positioning rib.

16. The keyswitch structure as claimed in claim 12, wherein each of the hooks has a base portion projected from the bottom face of the casing, and a bracket with a L-shaped arranged on one side of the base portion, wherein the base portion and the bracket are mated together to form an assembled opening.

17. The keyswitch structure as claimed in claim 16, wherein the base portion has an arc concave groove, and the balance rod is rotatably arranged inside the corresponding hooks and integrally formed on an end side of the connection portion.

18. The keyswitch structure as claimed in claim 16, wherein the base portion comprises a stop portion arranged inside the hook.

19. The keyswitch structure as claimed in claim 16, wherein the bracket has a rib projected from an inner side thereof.

20. The keyswitch structure as claimed in claim 12, wherein the key cap with a slender shape is exposed by the receiving groove.

* * * * *